US007363660B1

(12) United States Patent
Gilliland et al.

(10) Patent No.: US 7,363,660 B1
(45) Date of Patent: Apr. 29, 2008

(54) WORK GLOVE HAVING HANDLING TOOL

(76) Inventors: Travis W. Gilliland, 301 3rd St., Ridgeway, MO (US) 64481-8108; Kera K. Gilliland, 301 3rd St., Ridgeway, MO (US) 64481-8108

( * ) Notice: Subject to any disclaimer, the term of this patent is extended or adjusted under 35 U.S.C. 154(b) by 0 days.

(21) Appl. No.: 11/608,604

(22) Filed: Dec. 8, 2006

(51) Int. Cl.
*A41D 19/00* (2006.01)

(52) U.S. Cl. ..... 2/161.6; 2/163; 2/159; 2/160; 2/161.1; 2/161.2

(58) Field of Classification Search ..... 2/161.6, 2/163, 159, 160, 161.1, 161.2
See application file for complete search history.

(56) References Cited

U.S. PATENT DOCUMENTS 1,055,838 A * 3/1913 Torrance ..... 2/161.8
1,174,887 A 3/1916 Meriwether
1,358,824 A * 11/1920 Burden ..... 2/163
3,636,568 A 1/1972 Stuner
4,867,246 A * 9/1989 Kiger ..... 172/370
5,715,539 A 2/1998 Benecki et al.
6,014,775 A 1/2000 Missry
6,338,163 B1 * 1/2002 Markson ..... 2/163
D475,175 S 6/2003 Kopala
6,779,199 B1 8/2004 O'Dea et al.
6,810,530 B2 * 11/2004 Bryant, Sr. ..... 2/159

OTHER PUBLICATIONS

Magnetic Finger Glove from Griots Garage at http://www.griotsgarage.com/catalog.jsp?&SKU=50558&topnav=FRSPR06.

* cited by examiner

*Primary Examiner*—Gary L. Welch
*Assistant Examiner*—Alissa J Tompkins

(57) ABSTRACT

This patent discloses a work glove to retrieve, manipulate, and hold small metal articles. The work glove may include a palm protector, a thumb cover, an index cover, a middle cover, a ring cover, and a pinky cover. Each cover may allow a portion of the thumb and the digits to be exposed to the local environment. The work glove may include a handling tool having a base, a hood, and a tether attached between the base and the hood. The base may be attached to the front of the palm protector. The may include a pocket configured to fit about one of the thumb and digits of the human hand. A handling magnet may be attached to the hood and a first stowage magnet may be attached to the front of the palm protector to assist in stowing the handling tool.

17 Claims, 4 Drawing Sheets

WORK GLOVE HAVING HANDLING TOOL

BACKGROUND

1. Field of Endeavor

The information disclosed in this patent relates to a glove type hand covering that may be configured specially to assist and protect the hand of a user.

2. Background Information

Craftsman spend a lot of time using their hands to retrieve sharp fasteners such as nails and screws. Most wear nail bags around their waists arranged near the small of their back. A typical move for the craftsman is to reach behind themselves with their left hand, place their hand in the nail bag, feel the nails in the bag with their fingertips to get a sense of the arrangement of the nails, grab a desirably arranged nail, and then flip the nail into position within their fingers while removing their hand from the nail bag and bringing their hand towards the front of the craftsman's body for further processing. After repeating enough times, the craftsman develops a rhythm to this artistic movement.

Human fingers contain some of the densest areas of nerve endings on the human body and thus provide the richest source of tactile feedback in a craftsman's environment. However, during the cold of winter, a craftsman typically wears work gloves to keep their hands warm. In many cases, craftsmen retain the sensitivity in their fingers since these work gloves typically have their finger portions cut off to expose the craftsmen fingers. Despite their best efforts, it is very common for the tip of the nail or screw to prick the craftsman's finger tip or jab in between the finger nail and finger of the craftsman. For this and other reasons, it is difficult to pick up and hold small metal objects in the work environment experienced by craftsmen.

What is needed is an apparatus and method to overcome these and other problems.

SUMMARY

This patent discloses a work glove to retrieve, manipulate, and hold small metal articles. The work glove may include a palm protector, a thumb cover, an index cover, a middle cover, a ring cover, and a pinky cover. Each cover may allow a portion of the thumb and the digits to be exposed to the local environment. The work glove may include a handling tool having a base, a hood, and a tether attached between the base and the hood. The base may be attached to the front of the palm protector. The may include a pocket configured to fit about one of the thumb and digits of the human hand. A handling magnet may be attached to the hood and a first stowage magnet may be attached to the front of the palm protector to assist in stowing the handling tool.

DETAILED DESCRIPTION

Figure 1:
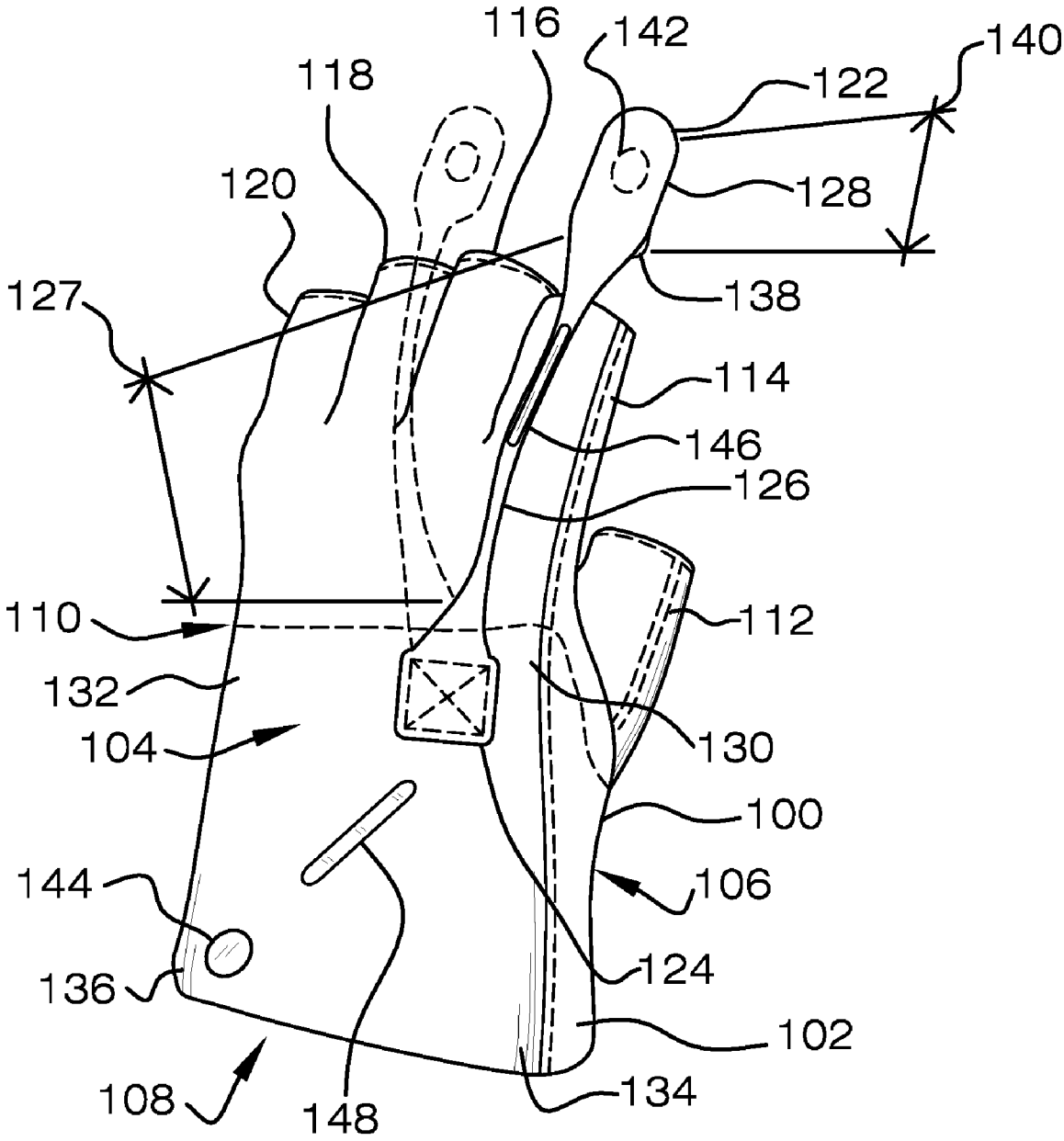
FIG. 1 is an isometric view of a work glove 100.

FIG. 1 is an isometric view of a work glove 100. Work glove 100 may include a palm protector 102 having a front 104 and a back 106. Palm protector 102 may have a flatten cylindrical shape having a palm protector opening 108. The flatten cylindrical shape may be configured to enclose a palm and wrist of a human hand.

At an outermost edge 110 of palm protector 102 may be a thumb cover 112, an index cover 114, a middle cover 116, a ring cover 118, and a pinky cover 120. Each cover 112, 114, 116, 118, and 120 may be configured to fit about a thumb, the four digits (an index finger, a middle finger, a ring finger, and a little finger (pinky finger)) of a human hand and allow a portion of the thumb and digits to be exposed to the local environment.

To allow a human to hold an object and grasp small objects, the four digits of a human hand may be folded over the hand palm and the thumb may be folded and rotated position to oppose any of the four digits. Outermost edge 110 of palm protector 102 may be defined as a line at which the four digits and thumb fold. On a side of work glove 100 having covers 112, 114, 116, 118, and 120, work glove 100 may move into a variety of configuration. On the side with palm protector 102, work glove 100 may remain relatively stable. In this way, work glove 100 may move along with the human hand while keeping the hand protected.

Work glove 100 additionally may include a handling tool 122. Handling tool 122 may aid a wearer of glove 100 to retrieve, manipulate, and hold small metal articles. The small metal articles may include nails, screws, clamps, nuts, washers, pins, bolts, and needles, for example.

Handling tool 122 may include a base 124, a tether 126, and a hood 128. Base 124 may be a swatch of material configured to anchor handling tool 122. For example, base 124 may be sewn to work glove 100 or attached by a fabric loop and hook fastener. The base 124, the hood 128, and the tether 126 may be a single piece construction. The base 124 and the tether 126 may be flat and without a cavity while the hood 128 may have pocket 138 in the form of a cavity.

To minimize interference by base 124 on movement of thumb cover 112, index cover 114, middle cover 116, ring cover 118, and pinky cover 120, base 124 may be attached to palm protector 102. In particular, front 104 of palm protector 102 may be divided into four corners: front upper right corner 130, front upper left corner 132, front lower right corner 134, and front lower left corner 136. Preferably, base 124 may be attached near front upper right corner 130. As will be discussed in more detail below, attaching base 124 in this location may permit handling tool 122 to reach the thumb and each of the four digits and efficiently be stored on work glove 100, all while minimizing interference by base 124 on movement of work glove 100.

Tether 126 may have a tether length 127 that may extend between base 124 and hood 128. Tether 126 may be made of a stretchable material. When hood 128 is installed on a digit or thumb, tether 126 may be in a stretched state that may provide a taunt pull on hood 128. This taunt pull on hood 128 may better secure hood 128 to the thumb or a digit of the hand. When in a relaxed, unstretched state, tether length 127 may be at a minimum to permit efficient storage of handling tool 122.

Hood 128 may have a pocket 138 configured to fit about the thumb or a digit of the hand. Pocket 138 may have a pocket length 140. The digits of a human hand may be divided into three sections: a distal phalange at the tips of the fingers, a proximal phalange next to the palm, and a middle or intermediate phalange between the distal and proximal phalange. Although the term phalange sometimes may mean bone, as used in this patent, the term phalange includes the bone and the fleshy part surrounding the bone, including the skin.

Pocket length 140 may be greater than 0.5 inches. The base 124, the hood 128, and the tether 126 may be a single piece construction. The base 124 and the tether 126 may be flat while the hood 128 may have pocket 138.

A human hand has five distal phalanges of varying distal phalange lengths, at least one of which may be the smallest and one may be the largest. Between each of the three sections is a joint that permit each digit freedom of movement. To minimize interfering with this movement, pocket length 140 may be less than the smallest distal phalange length.

Figure 3:
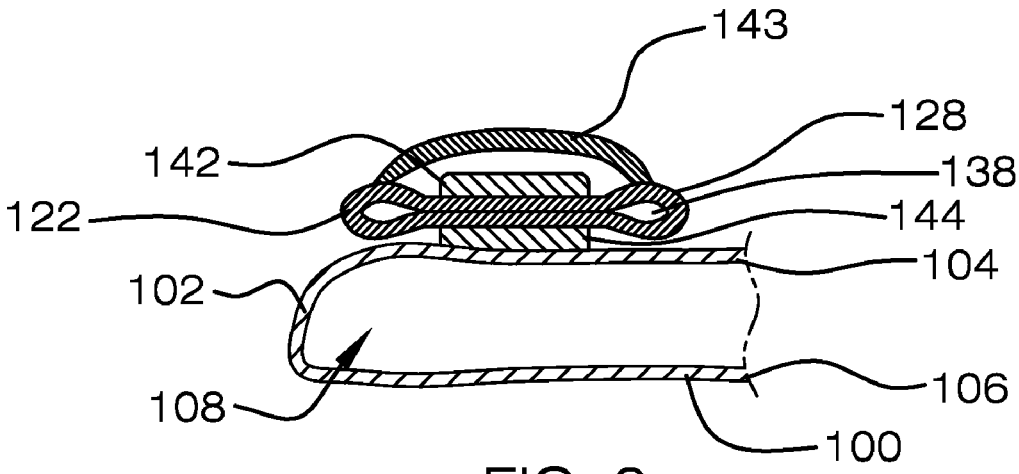
FIG. 3 is a sectional view of work glove 100 taken off line 3-3 of FIG. 2.

A handling magnet 142 may be attached to hood 128 and may be covered by a protective cover 143 (FIG. 3). Handling magnet 142 may be any article that possesses the property of attracting substances. Handling magnet 142 may be utilized to retrieve, manipulate, and hold small metal articles. Handling magnet 142 may have an oval shape. To ensure that handling magnet 142 is large enough to cover a most sensitive part of a finger and thumb of most human hands, handling magnet 142 may not have a diameter that is less than 0.4 inches. Moreover, handling magnet 142 may not have a diameter that is greater than 1.0 inches to ensure that handling magnet 142 does not interfere with movement of the digits and thumb of the hand.

When not in use, it may be desirable to stow handling tool 122 out of the way of fingers and thumb. If handling tool 122 were separated from work glove 100, handling tool 122 may become lost in the work environment. Thus, it may be desirable to keep handling tool 122 attached to work glove 100, even when handling tool 122 is not being used.

To store handling tool 122, work glove 100 may include a first stowage magnet 144, a second stowage magnet 146, and a third stowage magnet 148. First stowage magnet 144 may have a shape similar to handling magnet 142. First stowage magnet 144 may be located on work glove 100 as far as possible from base 124. For example, when base 124 is located near front upper right corner 130, first stowage magnet 144 may be located near front lower left corner 136. The diagonal between front upper right corner 130 and front lower left corner 136 may locate first stowage magnet 144 as far as possible from base 124.

Figure 2:
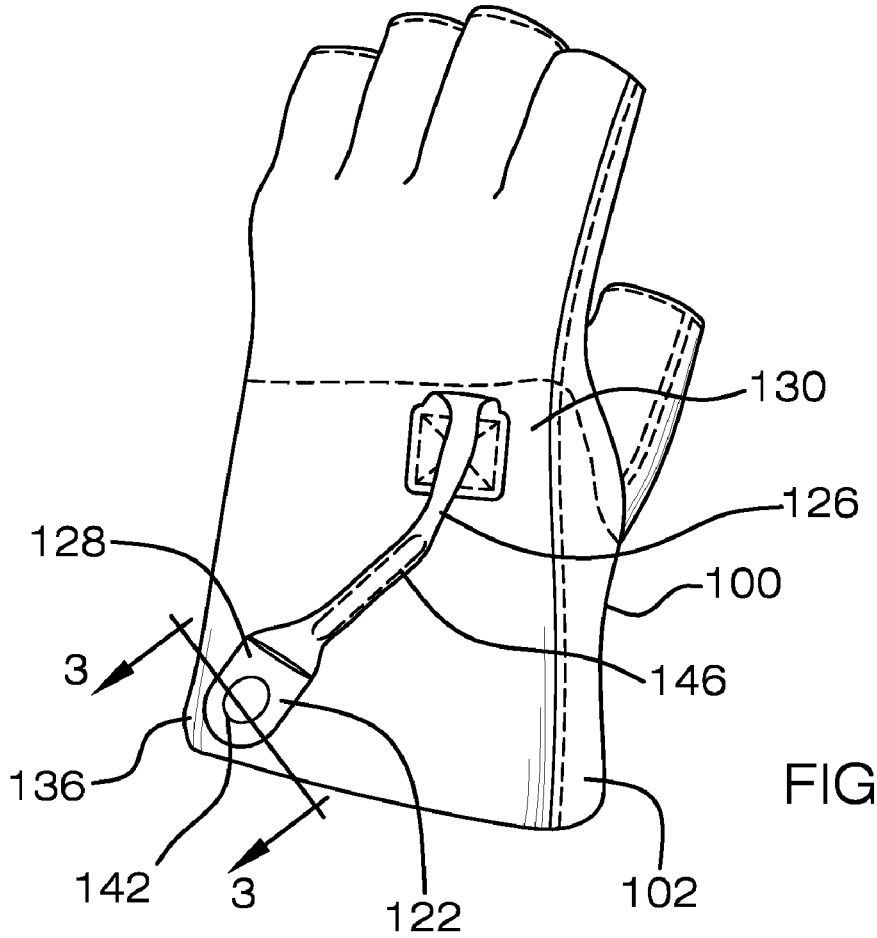
FIG. 2 is an isometric view of a work glove 100 with handling tool 122 in a stowed position.

FIG. 2 is an isometric view of a work glove 100 with handling tool 122 in a stowed position. To bring handling tool 122 to a stowed position, handling magnet 142 may be brought into contact with first stowage magnet 144. While this may secure hood 128, such an arrangement may create a loop between tether 126 and palm protector 102 that could snag on some item. To mitigate against this happening, second stowage magnet 146 may be attached to tether 126 and a third stowage magnet 148 may be attached to front 104 of palm protector 102. Both second stowage magnet 146 and third stowage magnet 148 may be elongated to follow the elongation of tether 126. With handling magnet 142 in contact with first stowage magnet 144 to secure hood 128, second stowage magnet 146 and third stowage magnet 148 may be brought into contact with each other to secure tether 126.

FIG. 3 is a sectional view of work glove 100 taken off line 3-3 of FIG. 2. When handling magnet 142 is in contact with first stowage magnet 144, hood 128 may be compressed between the magnets. This may minimize how far handling tool 122 rises above front 104. This may be important because the lower the profile of a stowed handling tool 122, the less likely handling tool 122 will interfere with use of work glove 100.

Figure 4:
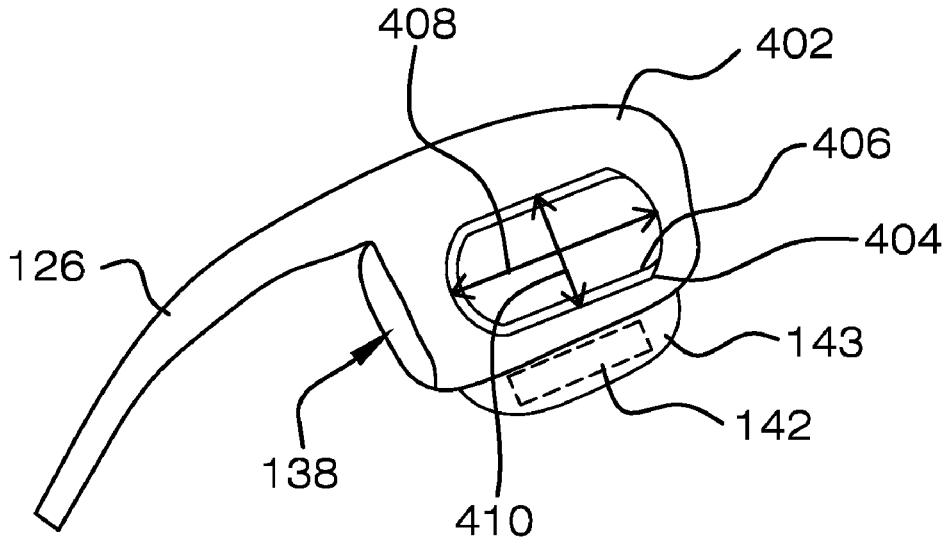
FIG. 4 is an isometric view of a hood 402 that may be utilized as part of a handling tool.

FIG. 4 is an isometric view of a hood 402 that may be utilized as part of a handling tool. Hood 402 may include a first sensitivity hole 404 and a second sensitivity hole 406 that may oppose first sensitivity hole 404. Each sensitivity hole 404, 406 may allow a wearer to feel the local environment using the sides of a digit or a thumb. Each sensitivity hole 404, 406 may be elliptical in shape and have a first sensitivity hole diameter 408 that is at least 0.5 inches and a second sensitivity hole diameter that is at least 0.25 inches.

Figure 5:
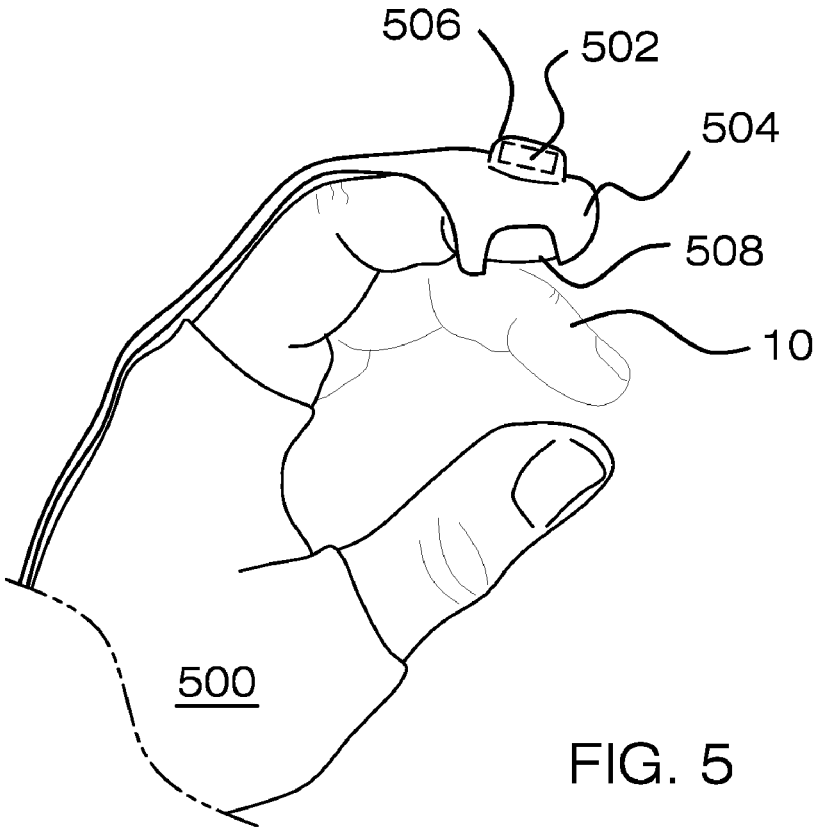
FIG. 5 is an isometric view of a work glove 500 installed on a hand 10.

FIG. 5 is an isometric view of a work glove 500 installed on a hand 10. Work glove 500 may include a handling magnet 502 positioned on a hood 504 and covered by a protective covering 506. In this example, handling magnet 502 may be positioned on hood 504 such that, when work glove 500 is installed on hand 10, handling magnet 502 may be positioned directly above a digit nail or thumbnail of hand 10. In situations where a craftsman reaches behind themselves to access a nail bag, it may be advantageous to have a magnet on the front side of work glove 500. Thus, handling magnet 502 may be positioned directly above a digit nail or thumbnail of hand 10. Alternatively, magnet 502 or a first magnet 502 and a second magnet 502 may be positioned on the sides of a digit nail or thumbnail of hand 10. Hood 504 may include a hood hole 508 configured to allow a user to feel with a digit nail or thumbnail of hand 10.

Figure 6:
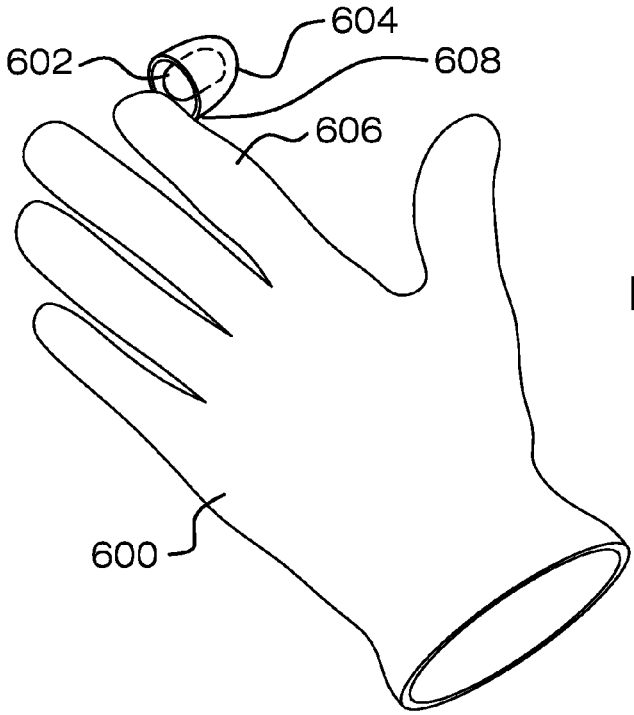
FIG. 6 is an isometric view of a work glove 600 configured to be installed on a hand 10 (not shown)
Figure 8:
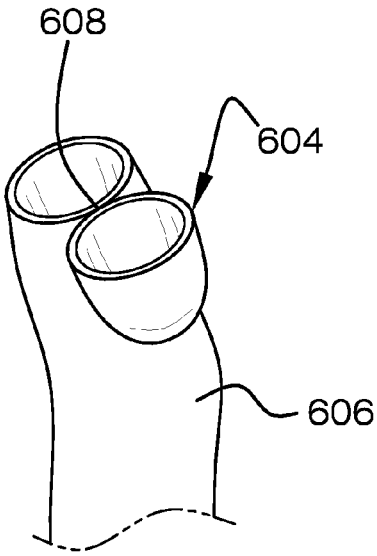
FIG. 8 is detailed view of a glove digit 606.
Figure 7:
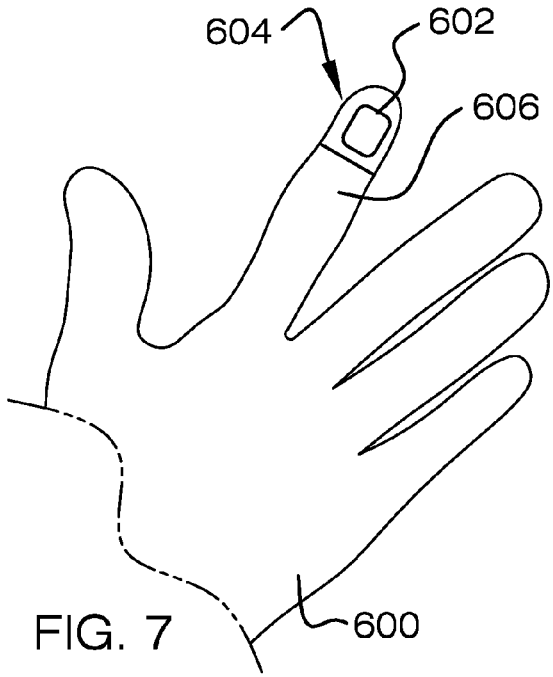
FIG. 7 is an elevated plan view of a work glove 600.

FIG. 6 is an isometric view of a work glove 600 configured to be installed on a hand 10 (not shown). FIG. 7 is an elevated plan view of a work glove 600. FIG. 8 is detailed view of a glove digit 606. Work glove 600 may include a handling magnet 602 positioned on a hood 604 that may be permanently or removeably sewn to glove digit 606 of work glove 600. Work glove 600 may have closed fingers and be made of materials such as cotton, leather, suede, and nylon. Handling magnet 602 substantially may measure ¾ inch to 1¼ inches long and ½ to ¾ inch wide. Hood 604 may include a hinge 608 such that when handling magnet 602 is no longer needed, a user may fold hood 604 back over glove digit 606.

The work glove may feature a magnetized tip at the digits or thumb of a human hand that may allow a worker to more easily pick up and hold small metal parts, components, and tools. The work glove may enable metal objects located in hard-to-reach areas to be more easily retrieved. Produced from material including cotton and leather, the work glove may be made in standard glove sizes.

The magnet may be secured into a pocket hood. The pocket hood may be folded back out of the way of the digits and thumb of a hand when no longer needed and the work glove then may be used without the magnet. The work glove may fulfill the need for a modified work glove featuring a magnetic tip that may make it easier to pick up and hold small metal objects. Appealing features of the work glove include its ease of use, convenience, accessibility to metallic objects, timesaving qualities and efficiency, cost effectiveness, and safety qualities. The ability to better hold and retrieve metallic objects may improve efficiency in many different types of work environments. With the work glove, the likelihood of an individual pricking their finger on a sharp fastener may be greatly reduced.

Commercial workers such as trades people, construction laborers, automotive mechanics, assemblers and fabricators, and general maintenance mechanics may utilize the work glove. Do-it-yourself enthusiasts may utilize the work glove as well when working with small metallic objects.

The work glove provides a number of benefits that may be tailored to the needs of the users. The work glove may be configured to assist the user to get nails, screws, bolts and other metal objects out of a carpentry bag without poking their figures. The work glove may give better control of the object a worker may be handling. General users of the work glove may include, but not be limited to, carpenters, mechanics, and assembly line workers.

For example, carpenters reaching into their carpentry bags usually get their fingers poked by the nails and/or screws. With the work glove, a carpenter may reach into the bag and grab a single nail or screw with out being poked. Mechanics put nuts and bolts in a tight spot and find it frustrating being in a tight spot with your wrench a finger tip away. With the work glove, a mechanic may "drag" the wrench to the mechanic. Assembly line workers perform at a very fast pace and may be constantly reaching for a bolt in a bolt tray. The tread on the bolts often cuts their skin and becomes very painful at the end of the day. Wearing the work glove will prevent this from happening and has an added bonus of making the bolt come to the assembly line worker rather than the assembly line worker going to bolt.

The work glove may be a most advanced product of its kind in the marketplace. Not only may the short and long-term economic advantages of using the work glove be exceptional, but also the characteristics of the work glove may ensure that the user has the potential to manage a task as quickly as possible.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A work glove, comprising:

a palm protector having a front, a back, and an outermost edge of the palm protector;

a thumb cover, an index cover, a middle cover, a ring cover, and a pinky cover, where each cover is attached to and configured to fold at the outermost edge of the palm protector and each cover is configured to fit about a thumb, and the four digits of a human hand while allowing a portion of the thumb and the digits to be exposed to the local environment;

a handling tool having a base, a hood, and a tether attached between the base and the hood, where the base is attached to the front of the palm protector, where the hood includes a pocket configured to fit about one of the thumb and digits of the human hand, where the hood includes a hood finger pad side configured to align with a pad of a human finger and includes a hood fingernail side facing in an opposite direction from the hood finger pad side and configured to align with a fingernail of that same human finger;

a handling magnet attached to the finger pad side of the hood, where the handling magnet is configured to assist in stowing the hood and to at least one of retrieving, manipulating, and holding small metal articles; and a first stowage magnet attached to the front of the palm protector and configured to assist in stowing the handling tool, where when the handling magnet is held to the first stowage magnet, both the hood finger pad side and the hood fingernail side are compressed between the handling magnet and the first stowage magnet.

2. The work glove of claim 1, where the first stowage magnet has a shape similar to the handling magnet and where the work glove contains no more than two magnets and no less than two magnets.

3. The work glove of claim 1, where the handling magnet has an oval shape.

4. The work glove of claim 3, where the handling magnet has a diameter that is not less than 0.4 inches and is not greater than 1.0 inches.

5. The work glove of claim 1, where the first stowage magnet is located on the palm protector as far as possible from the base.

6. The work glove of claim 5, where the palm protector is divided into a front upper right corner, a front upper left corner, a front lower right corner, and a front lower left corner, where the base is attached near the front upper right corner and the first stowage magnet is located near the front lower left corner.

7. The work glove of claim 1, where the tether has a tether length that extends between the base and the hood, where the tether is made of stretchable material, and where, when the hood is installed on one of a digit and thumb of a human hand, the tether will be in a stretched state that provides a taunt pull on the hood and when uninstalled from one of a digit and thumb of a human hand and in a relaxed, unstretched state, the tether length will be at a minimum.

8. The work glove of claim 1, where the base, the hood, and the tether are a single piece construction and where the base and the tether are flat and without a cavity and the hood includes the pocket in the form of a cavity.

9. The work glove of claim 1, where the pocket includes a pocket length that is greater than 0.5 inches.

10. The work glove of claim 9, where the pocket length is less than a smallest distal phalange length of a human hand.

11. The work glove of claim 1, further comprising a second stowage magnet attached to the tether and a third stowage magnet attached to the front of the palm protector between the base and the first stowage magnet, where the second stowage magnet and the third stowage magnet are elongated to follow an elongation of the tether, where the second stowage magnet and third stowage magnet are configured to attach to each other to attach the tether to the palm protector.

12. The work glove of claim 1, where the hood includes a first sensitivity hole and a second sensitivity hole that opposes first sensitivity hole, where each sensitivity hole is configured to allow a wearer of the work glove to feel the local environment using the sides of a distal phalange of the digit or the sides of a distal phalange of the thumb inserted into the hood.

13. The work glove of claim 12, where the first sensitivity hole and the second sensitivity hole each are elliptical in shape and have a first sensitivity hole diameter that is at least 0.5 inches and a second sensitivity hole diameter that is at least 0.25 inches.

14. The work glove of claim 1, further comprising:

a protective cover attached to the finger pad side of the hood, where the handling magnet is completely enclosed by the protective cover and the finger pad side of the hood so as to be attached to the finger pad side of the hood by the protective cover.

15. A work glove, comprising:

a glove digit having a stowage magnet attached thereto;

a hood attached to the glove digit by a hinge, where the hood includes a hood finger pad side configured to align with a pad of a human finger and includes a hood fingernail side facing in an opposite direction from the hood finger pad side and configured to align with a fingernail of that same human finger; and a handling magnet attached to the finger pad side of the hood by a protective cover sewn to the finger pad side of the hood, where the work glove includes closed fingers and is made of at least one material from the group cotton, leather, suede, and nylon, and where when the handling magnet is no longer needed, the hood is configured to fold back over the glove digit so that when the handling magnet is held to the stowage magnet, both the hood finger pad side and the hood fingernail side are compressed between the handling magnet and the stowage magnet.

16. A work glove, comprising:

a palm protector having a front, a back, and an outermost edge of the palm protector;

a thumb cover, an index cover, a middle cover, a ring cover, and a pinky cover, where each cover is attached to and configured to fold at the outermost edge of the palm protector and each cover is configured to fit about a thumb, and the four digits of a human hand while allowing a portion of the thumb, the index finger, and the middle finger to be exposed to the local environment;

a handling tool having a base, a hood, and a tether attached between the base and the hood, where the base is attached to a front of the work glove, where the hood includes a pocket configured to fit about one of the thumb and digits of the human hand, where the hood includes a hood finger pad side configured to align with a pad of a human finger and includes a hood fingernail side facing in an opposite direction from the hood finger pad side and configured to align with a fingernail of that same human finger;

a handling magnet attached to the finger pad side of the hood, where the handling magnet is configured to assist in stowing the hood and to at least one of retrieving, manipulating, and holding small metal articles; and a stowage magnet attached to the front of the palm protector and configured to assist in stowing the handling tool, where when the handling magnet is held to the first stowage magnet, both the hood finger pad side and the hood fingernail side are compressed between the handling magnet and the first stowage magnet.

17. The work glove of claim 16, where a line on an upper most area of the palm protector that corresponds to the area at which the four digits and thumb of a human fold is defined as an outermost edge of the palm protector and where the stowage magnet is attached adjacent to both the outermost edge of the palm protector and to the index cover.

* * * * *